US006416581B1

(12) United States Patent
Huang et al.

(10) Patent No.: US 6,416,581 B1
(45) Date of Patent: Jul. 9, 2002

(54) APPARATUS FOR VEILING COMPUTER ENCLOSURE FROM COATING

(75) Inventors: Kuo-Lun Huang; Ming-Cheng Chang, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/479,311

(22) Filed: Jan. 6, 2000

(30) Foreign Application Priority Data

Dec. 9, 1999 (TW) ..... 88121593 A

(51) Int. Cl.[7] ..... B05C 13/02
(52) U.S. Cl. ..... 118/504; 118/505
(58) Field of Search ..... 118/504, 505, 118/715; 427/272, 282; 220/235, 236, 237, 238, 251, 323

(56) References Cited

U.S. PATENT DOCUMENTS 4,036,171 A * 7/1977 Ramet ..... 118/50
4,745,878 A * 5/1988 Sagawa ..... 118/505
4,891,244 A * 1/1990 Wallace ..... 118/DIG. 16

* cited by examiner

*Primary Examiner*—Laura Edwards
(74) *Attorney, Agent, or Firm*—Wei Te Chung

(57) ABSTRACT

An apparatus for veiling a predetermined position of a computer enclosure from coating, comprises a first cover, a second cover attached to the first cover and a cap mounted on the first and second covers. The first cover comprises a first housing, a first turnplate pivotably mounted on the first housing, and a plurality of first veiling plates movably mounted on the first housing and the first turnplate. The second cover comprises a second housing, a second turnplate pivotably mounted on the second housing, and a plurality of second veiling plates movably mounted on the crossing housing and the second turnplate. The second veiling plates are situated between the first veiling plates of the first cover.

19 Claims, 12 Drawing Sheets

APPARATUS FOR VEILING COMPUTER ENCLOSURE FROM COATING

BACKGROUND OF THE INVENTION

1. Field of the Invention

The present invention relates to an apparatus for veiling a computer enclosure from coating, and particularly to an apparatus including first and second covers coupled together to be received in the computer enclosure for veiling the computer enclosure from the coating.

2. Description of Prior Art

A computer enclosure in the computer industry is often finished with a coating to improve the appearance of the enclosure. A surface of the computer enclosure fully exposed to external space is fully coated. Once the surface of the computer enclosure is partially exposed to external space, the unexposed portion of the computer enclosure is veiled from coating. For example, to coat a computer enclosure defining a reception chamber for receiving batteries needs to coat part of side walls of the reception chamber, therefore an adhesive tape is applied on the bottom surface of the recessed chamber and another part of side walls of the reception chamber during a coating procedure for preventing the unexposed portion from being coated.

Conventionally, an adhesive tape is formed with a special size and attached to an uncoated portion of a computer enclosure for veiling the uncoated portion of the computer enclosure from being coated. After the computer enclosure is coated, the adhesive tape is detached from the computer enclosure thereby exposing the uncoated portion. However, to obtain a special size of adhesive tape and to attach it to and detach from the uncoated portion of the enclosure is time-consuming thus reducing efficiency and increasing cost. Furthermore, adhesive material of the adhesive tape easily remains on the computer enclosure during the adhesive tape being detached from the computer enclosure. To clean the adhesive matter from the computer enclosure easily damages the surface of the computer enclosure. Additionally, it is hard to obtain an accurate size adhesive tape and to attach the adhesive tape to an accurate position. So coating area of the computer enclosure is hard to controlled.

SUMMARY OF THE INVENTION

Accordingly, an object of the present invention is to provide an apparatus readily attached to a computer enclosure for veiling a computer enclosure from coating.

Second object of the present invention is to provide an apparatus for veiling a computer enclosure at a predetermined position from coating for facilitating controlling coating area.

To achieve the objects of the present invention, an apparatus for veiling a predetermined position of a computer enclosure from coating, comprises a first cover, a second cover attached to the first cover and a cap mounted on the first and second covers. The first cover comprises a first housing, a first turnplate pivotably mounted on the first housing, and a plurality of first veiling plates movably mounted on the first housing and the first turnplate. The second cover comprises a second housing, a second turnplate pivotably mounted on the second housing, and a plurality of second veiling plates movably mounted on the crossing housing and the second turnplate. The second veiling plates are situated between the first veiling plates of the first cover.

BRIEF DESCRIPTION OF THE DRAWINGS

Other objects and advantages of the present invention will be understood from the following description of an apparatus for veiling a computer enclosure from coating according to a preferred embodiment of the present invention shown in the accompanying drawings, in which.

DETAILED DESCRIPTION OF THE PREFERRED EMBODIMENT

Figure 1:
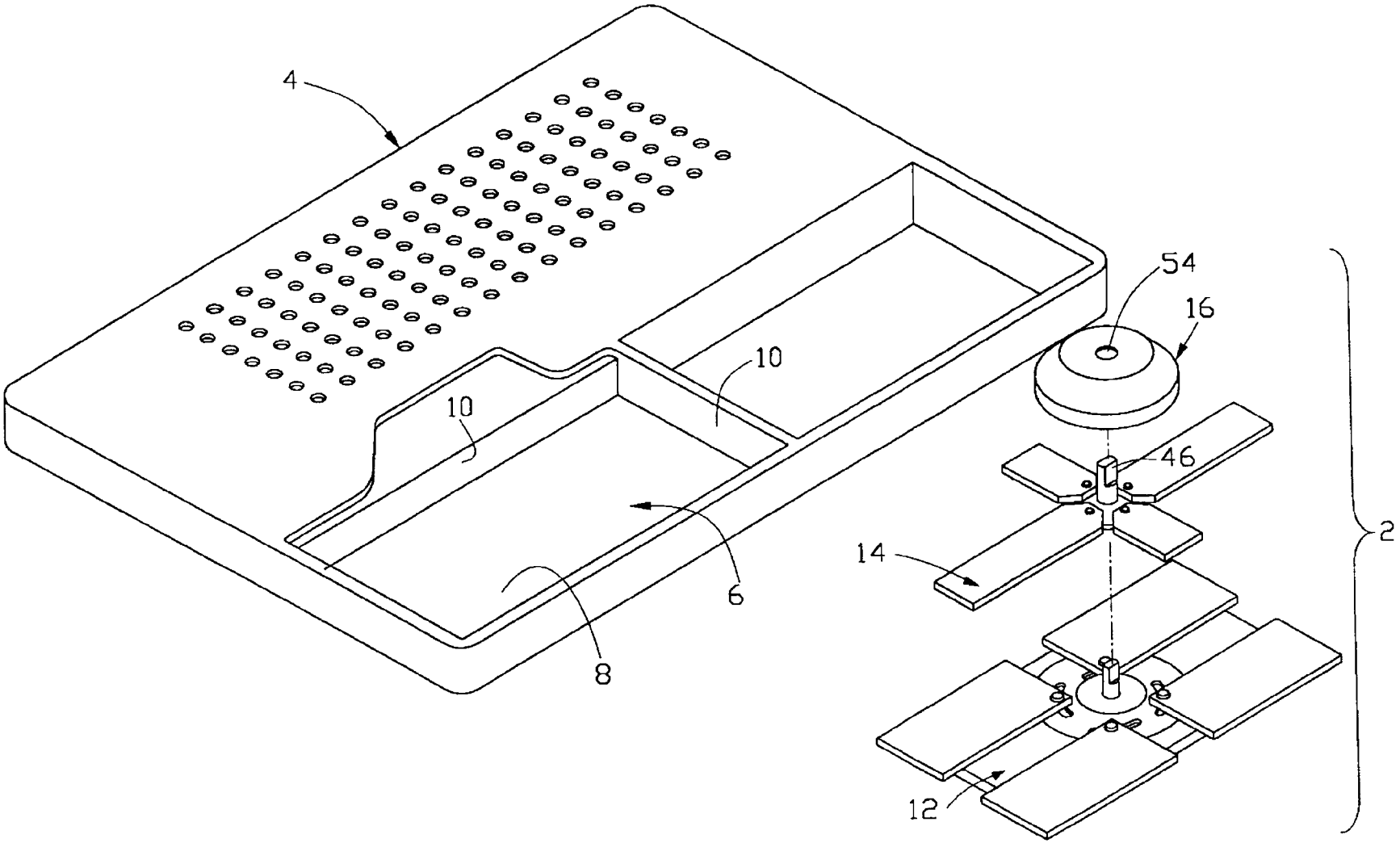
FIG. 1 is an exploded view of an apparatus in accordance with the present invention for veiling a specific region of a computer enclosure from coating.

FIG. 1 shows an apparatus 2 of the present invention to be attached to a computer enclosure 4 for veiling the computer enclosure 4 from coating. The computer enclosure 4 includes a reception chamber 6 formed with a bottom wall 8 and four side walls 10 extending from the bottom wall 8. The reception chamber 6 is used to receive a battery (not shown) or other components. So the bottom wall 8 and a part of the side walls 10 of the reception chamber 6 are unexposed to external space and do not need coating. The apparatus 2 is used to veil the uncoated portions of the reception chamber 6 of the computer enclosure 4 when the computer enclosure 4 is being coated. The apparatus 2 includes a first cover 12, a second cover 14 attached to the first cover 12 and a cap 16 attached to the second cover 14.

Figure 2:
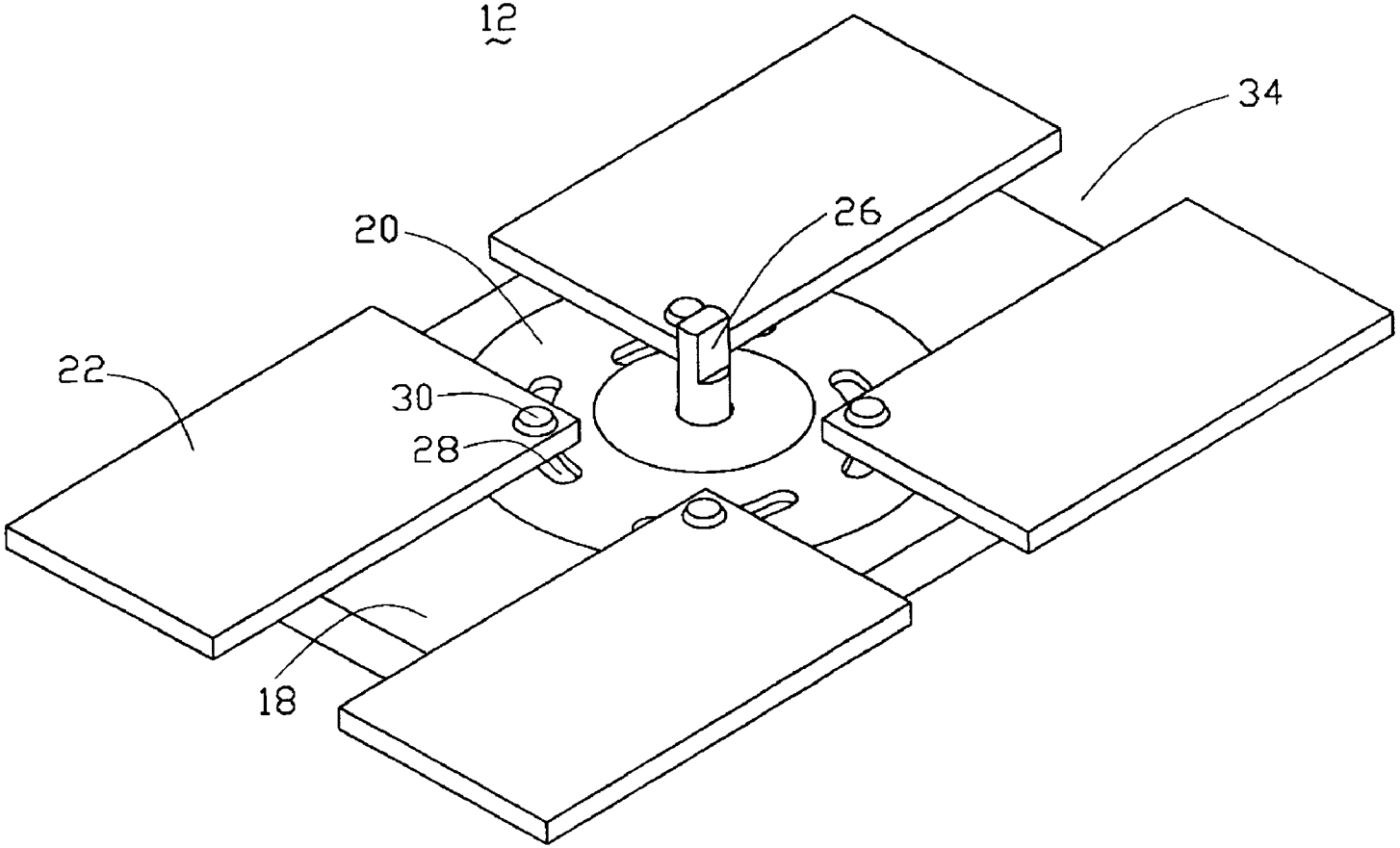
FIG. 2 is a perspective view of the first cover of FIG. 1.
Figure 3:
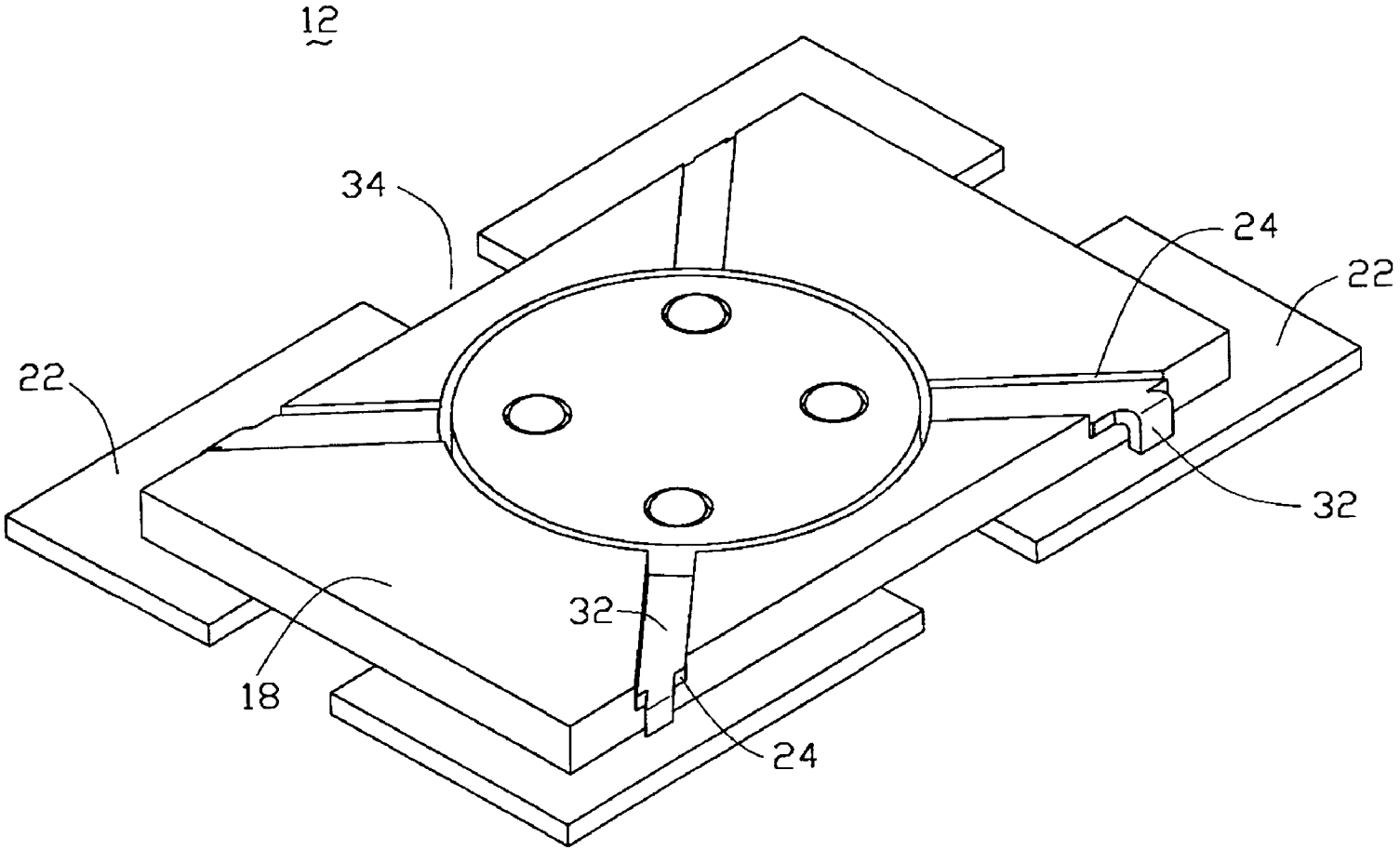
FIG. 3 is similar to FIG. 2 showing the first cover viewed from an opposite direction.

Referring to FIGS. 2 and 3, the first cover 12 includes a rectangular housing 18, a first turnplate 20 pivotably mounted on the center of the rectangular housing 18, and four first veiling plates 22 movably mounted on the rectangular housing 18 and the first turnplate 20. The rectangular housing 18 defines two pairs of first sliding slots 24 respective in crossing directions. A suppositional intersection of the two pairs of first sliding slots 24 is the center of the rectangular housing 18 about which the first turnplate 20 is pivoted. Each first sliding slot 24 is formed with a 45 degrees angle relative to corresponding edges of the rectangular housing 18.

Figure 4:
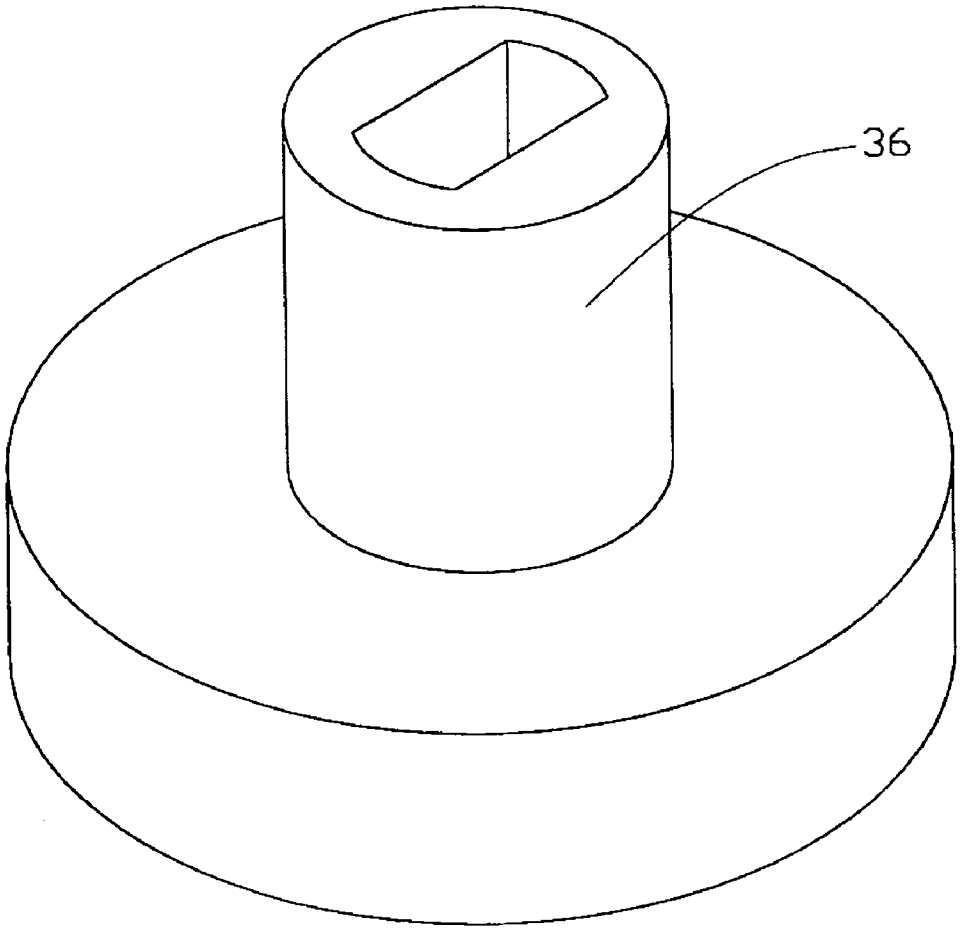
FIG. 4 is perspective view of a first tool.

A first actuating post 26 extends from the center of the first turnplate 20 for pivoting the first turnplate 20 about the rectangular housing 18. The first turnplate 20 defines four first arcuate slots 28 each of which has a center portion and two end portions communicating with the center portion, wherein the center portion is placed from the first actuating post 26 with a distance farther than that of the two end portions spaced from the first actuating post 26. Each first veiling plate 22 defines a first through hole (not shown) at a corner thereof for extension of a fastener 30 movably received in the first arcuate slot 28 of the first turnplate 20. The fastener 30 is formed with a guiding portion 32 for being movably received in the first sliding slot 24 of the rectangular housing 18. A crossing gap 34 is defined among the first veiling plates 22. When the first actuating post 26 is rotated by a first tool 36 as shown in FIG. 4, the fasteners 30 are exerted by the first turnplate 20 to move the first veiling plates 22 along the first sliding slots 24 of the rectangular housing 18.

Figure 5:
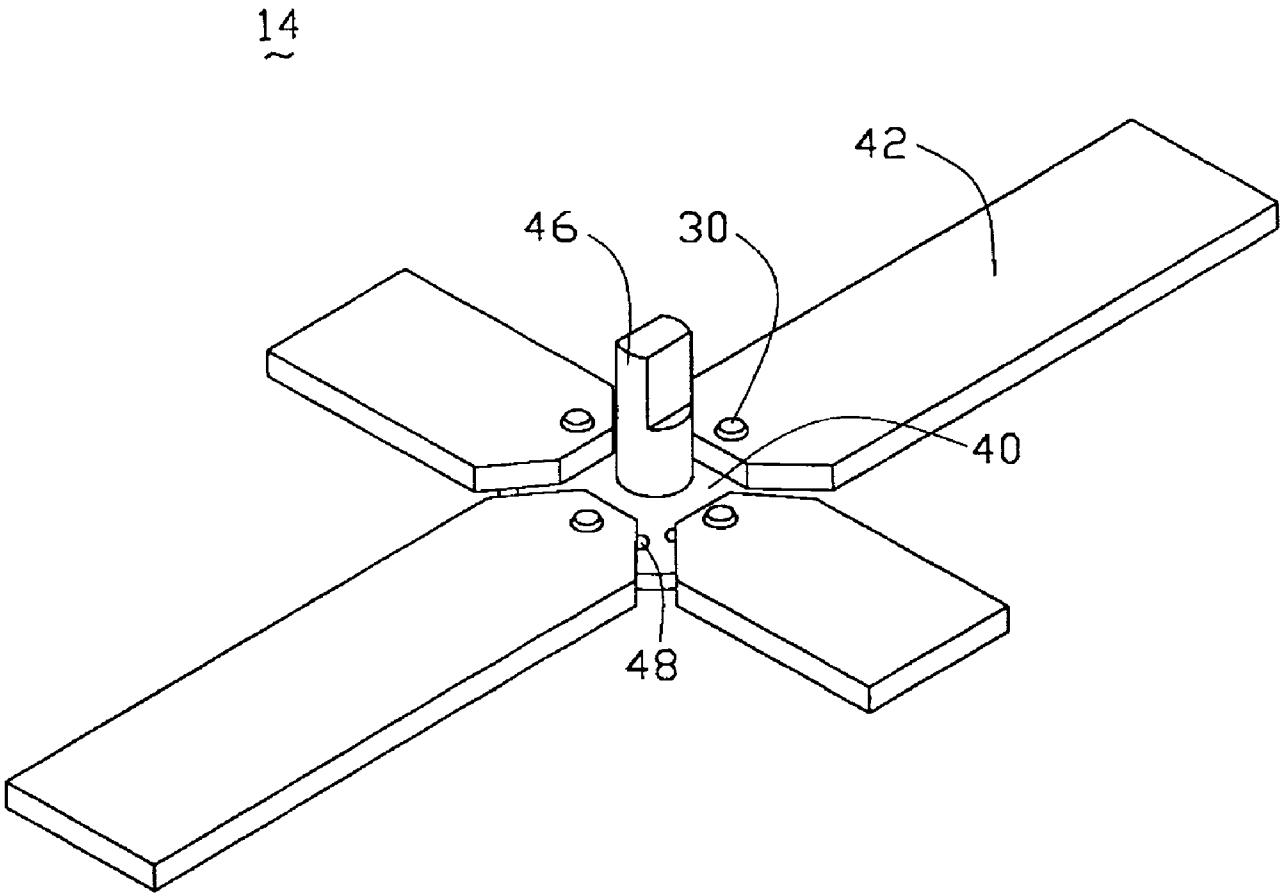
FIG. 5 is a perspective view of the second cover of FIG. 1.
Figure 6:
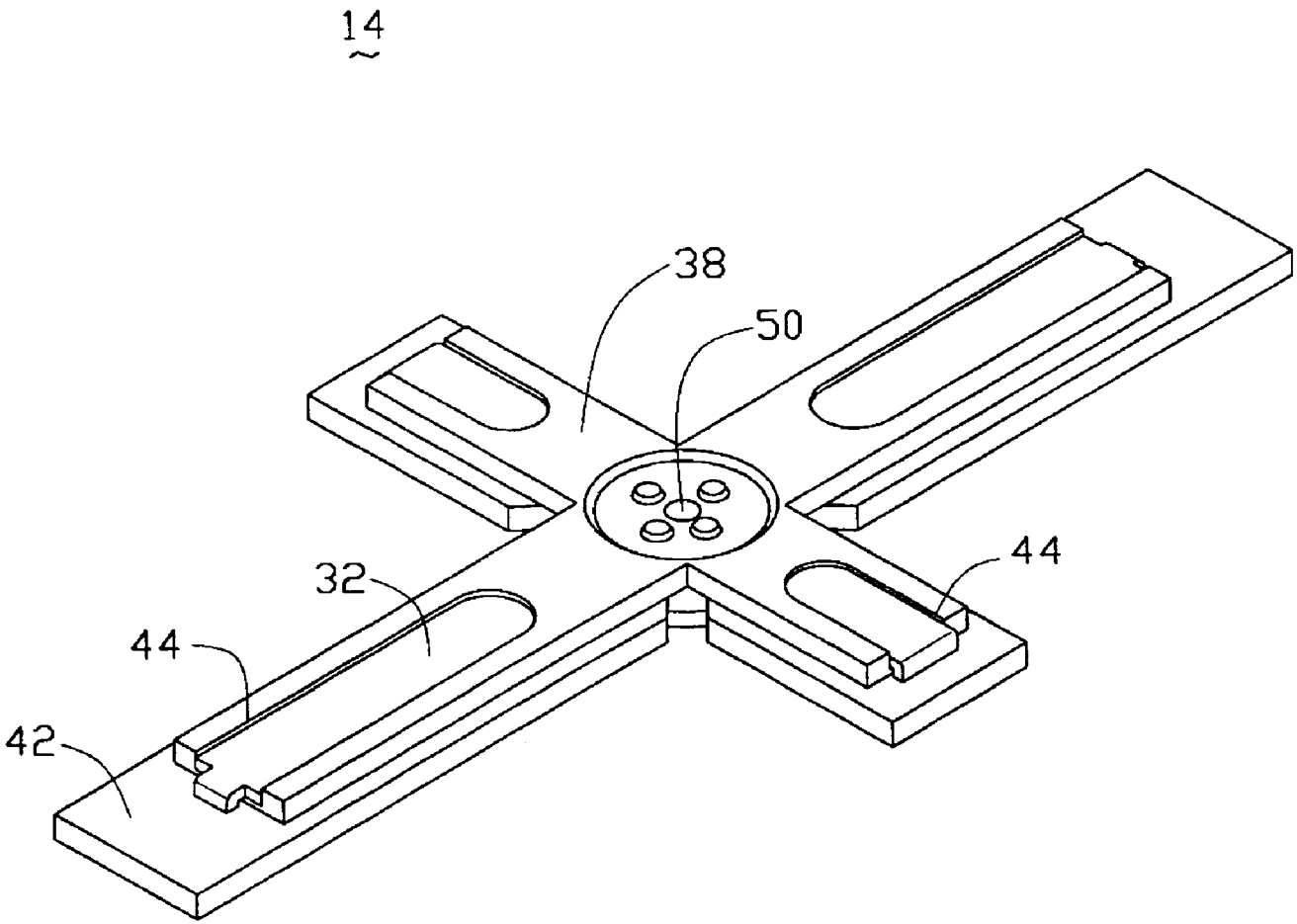
FIG. 6 is a perspective view taken from an opposite angle of FIG. 5.

Referring to FIGS. 5 and 6, the second cover 14 includes a crossing housing 38, a second turnplate 40 pivotably mounted on the center of the crossing housing 38, and four second veiling plates 42 movably mounted on the crossing housing 38 and the second turnplate 40. The crossing housing 38 defines two pairs of second sliding slots 44 respective in crossing directions. A suppositional intersection of the two pairs of second sliding slots 44 is the center of the crossing housing 38 about which the second turnplate 40 is pivoted. Each second sliding slot 44 is formed with a 45 degrees angle relative to corresponding edges of the crossing housing 38.

Figure 7:
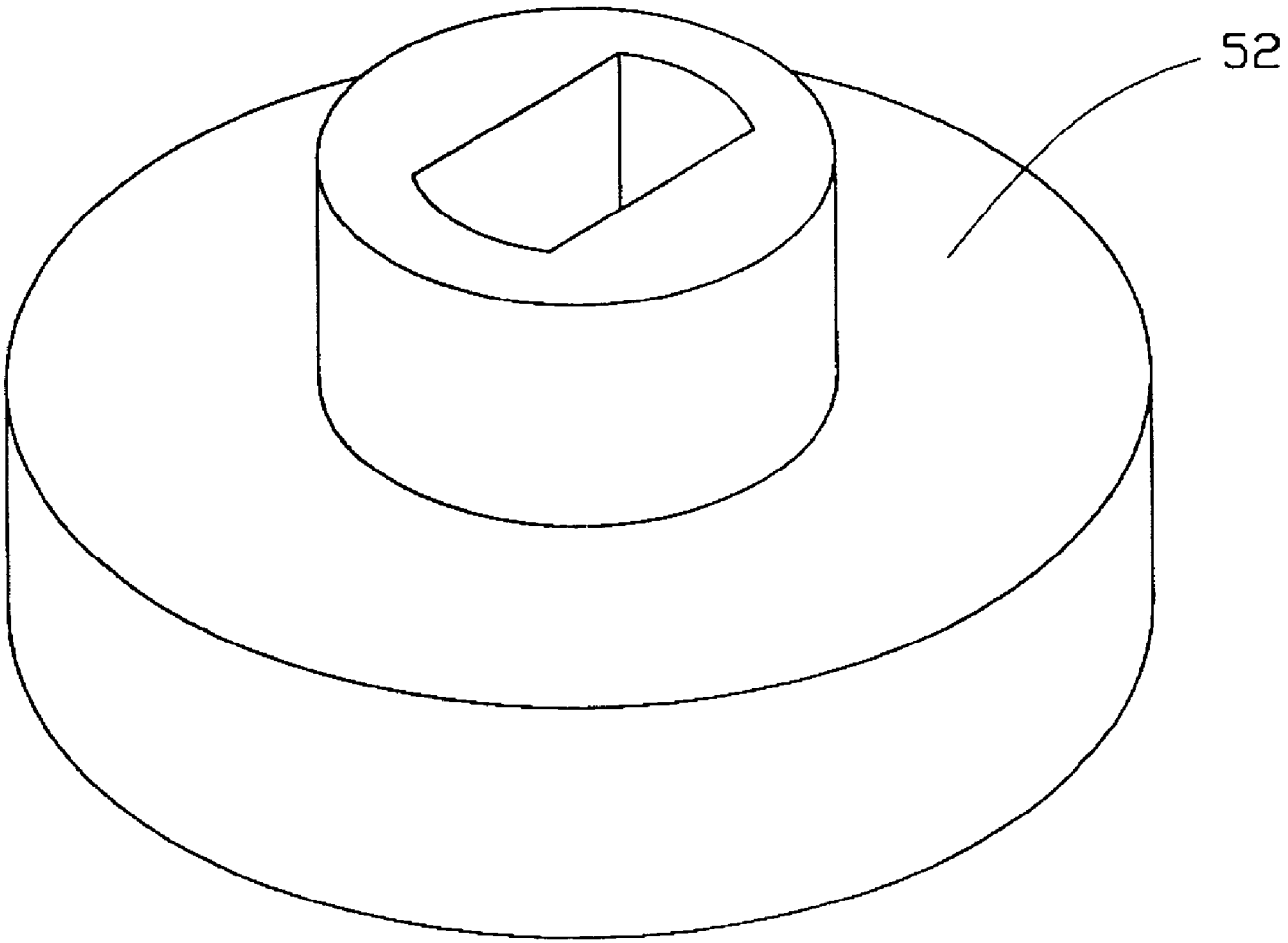
FIG. 7 is a perspective view of a second tool.

A second actuating post 46 extends from the center of the second turnplate 40 for pivoting the second turnplate 40 about the crossing housing 38. The second turnplate 40 defines four second arcuate slots 48 each of which has a center portion and two end portions communicating with the center portion, wherein the center portion is placed from the second actuating post 46 with a distance farther than that of the two end portions spaced from the second actuating post 46. Each second veiling plate 42 defines a through hole (not shown) at an end thereof for extension of the fastener 30 movably received in the second arcuate slot 48 of the second turnplate 40. The guiding portion 32 of the fastener 30 is movably received in the second sliding slot 44 of the crossing housing 18. A receiving aperture 50 is defined through the crossing housing 38 and into the second turnplate 40 for receiving the first actuating post 26 of the first turnplate 20. When the second actuating post 46 is rotated by a second tool 52 as shown in FIG. 7, the fasteners 30 are exerted by the second turnplate 40 to move the second veiling plates 42 along the second sliding slots 44 of the crossing housing 38. The cap 16 defines a hole 54 (shown in FIG. 1) for extension of the second actuating post 46 of the second cover 14.

Figure 8:
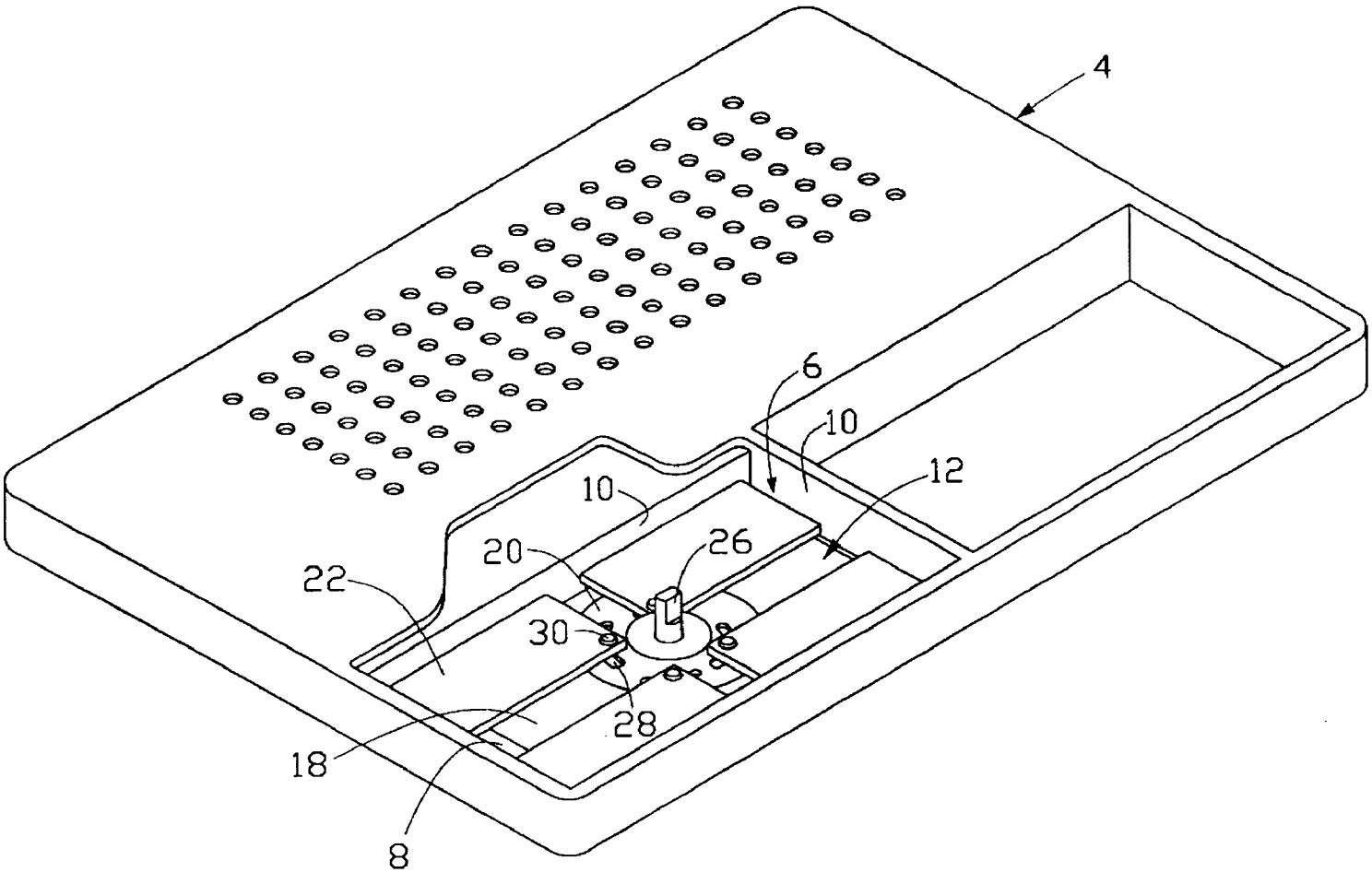
FIG. 8 is a partially assembled view of FIG. 1 showing that the first cover is loosely received in the computer enclosure.
Figure 9:
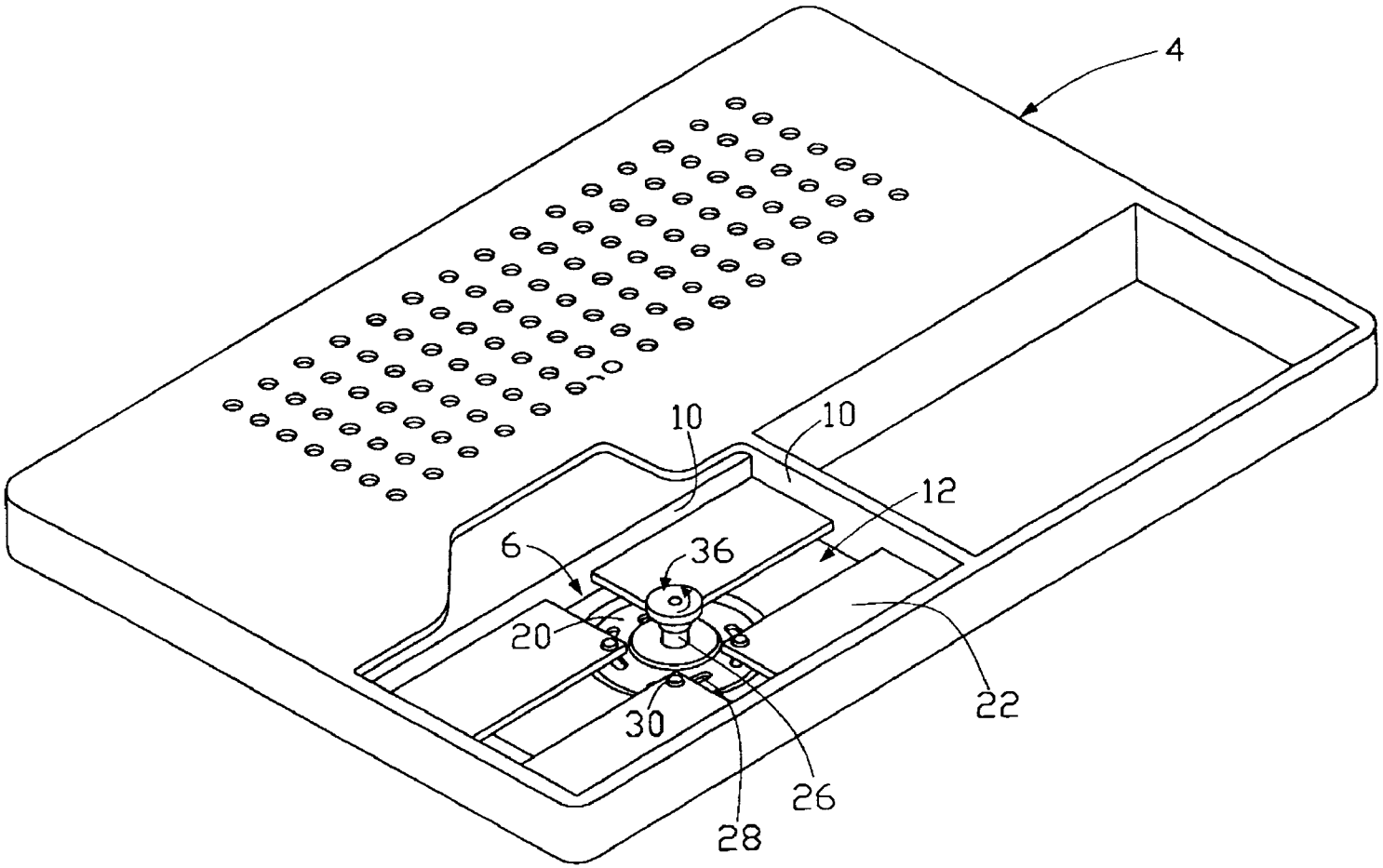
FIG. 9 is similar to FIG. 8 showing that the first cover is engagingly received in the computer enclosure.

Referring to FIG. 8, the first cover 12 is loosely received in the recessed chamber 6 of the computer enclosure 4 with the rectangular housing 18 thereof being supported by the bottom wall 8 of the recessed chamber 6. Then referring to FIG. 9, the first actuating post 26 of the first turnplate 20 is rotated by a first tool 36, and the fasteners 30 are exerted by the first turnplate 20 to move the first veiling plates 22 along the first sliding slots 24 (see FIG. 3) of the rectangular housing 18 until the first veiling plates 22 securely contact the side walls 10 of the recessed chamber 6 of the computer enclosure 4. Thus, the first cover 12 is readily fixed to the recessed chamber 6 of the computer enclosure 4.

Figure 10:
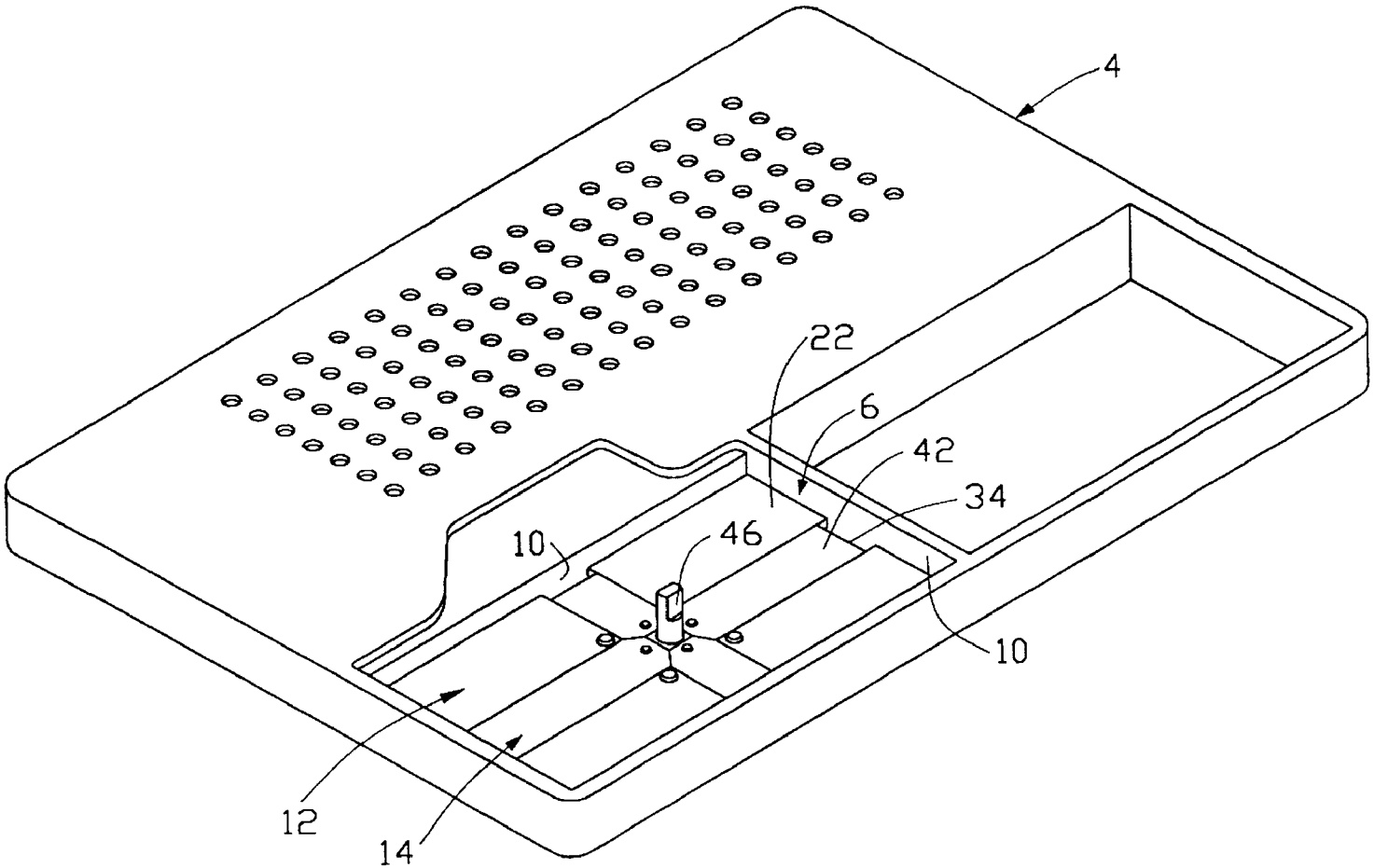
FIG. 10 is a partially assembled view of FIG. 1 showing that the second cover is maitingly and loosely attached to the first cover of FIG. 9.
Figure 11:
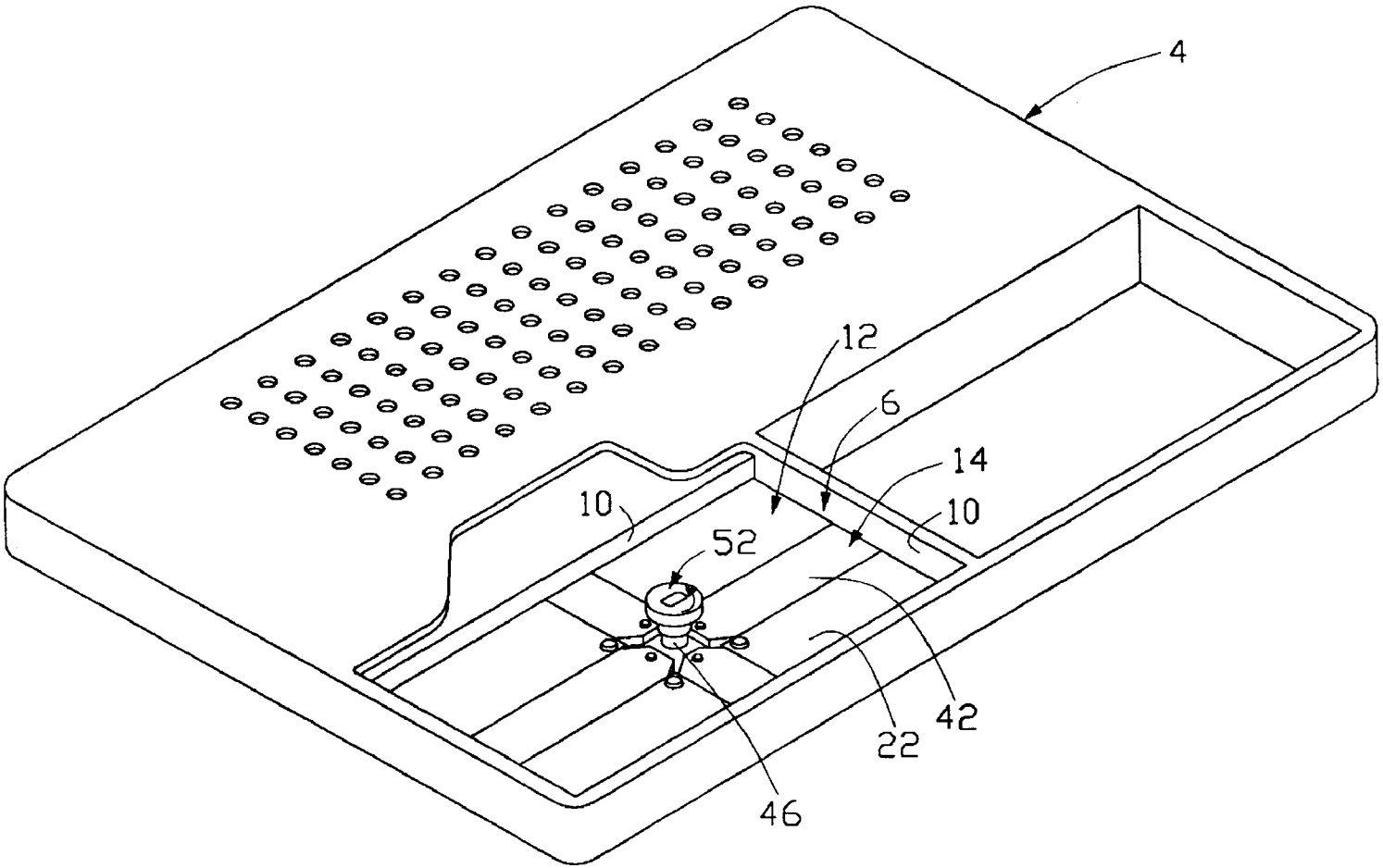
FIG. 11 is similar to FIG. 10 showing that the second cover is securely received in the computer enclosure.

Referring to FIG. 10, the second cover 14 is received in the crossing gap 6 of the first cover 14 matingly in width with the receiving aperture 50 (see FIG. 6) thereof receiving the first actuating post 26 of the first cover 12 therein. Then referring to FIG. 11, the second actuating post 46 of the second turnplate 40 is rotated by a second tool 52, and the fasteners 30 are exerted by the second turnplate 40 to move the second veiling plates 42 along the second sliding slots 44 (see FIG. 6) of the crossing housing 38 until the second veiling plates 42 securely contact the side walls 10 of the recessed chamber 6 of the computer enclosure 4. Thus, the second cover 14 is readily fixed to the recessed chamber 6 of the computer enclosure 4.

Figure 12:
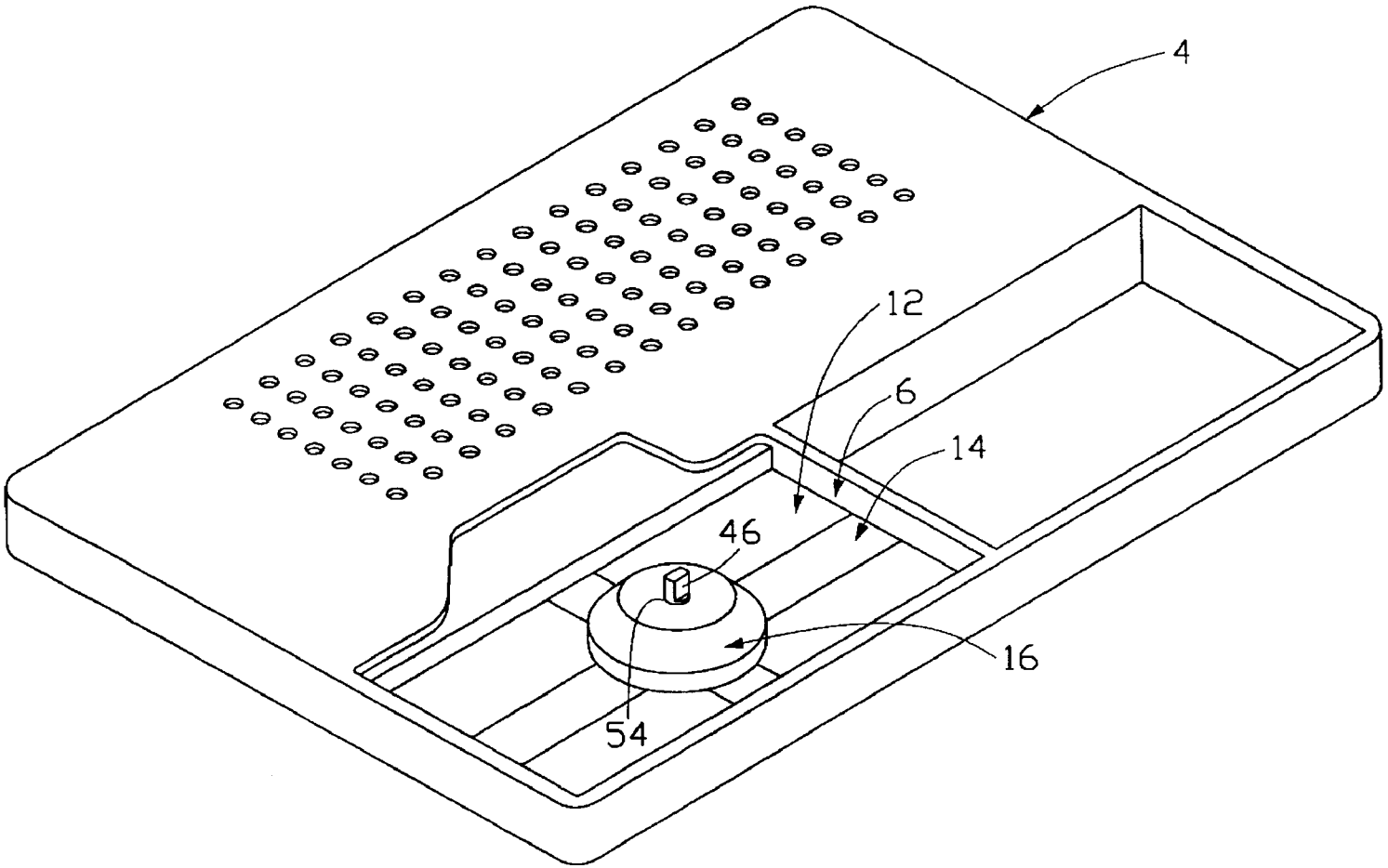
FIG. 12 is an assembled view of FIG. 1.

Referring to FIG. 12, the cap 16 is mounted on the first and second covers 12, 14 with the hole 54 thereof receiving the second actuating post 46 of the second cover 14 therein. Thus, the apparatus 2 is easily assembled and accurately attached to the recessed chamber 6 of the computer enclosure 4 for veiling the bottom wall 8 (see FIG. 1) and part of the side walls 10 of the recessed chamber 6 of the computer enclosure 4 from coating.

During coating, the first and second covers 12, 14 veil the predetermined position (uncoated portion) of the computer enclosure 4 from coating. The cap 16 is positioned on the center of the first and second covers 12, 14 for preventing the internal portions thereof from coating. After coating, the apparatus 2 is readily disassembled from the computer enclosure 4 in a reverse way of assembly without damaging the coating of the computer enclosure 4.

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. An apparatus adapted for veiling a predetermined position of a computer enclosure from coating, comprising:

a first cover adapted to be accommodated in the predetermined position of the computer enclosure, the first cover comprising a first housing, a first turnplate pivotably mounted on the first housing, and a plurality of first veiling plates movably mounted on the first housing and the first turnplate;

a second cover adapted to be accommodated in the predetermined position of the computer enclosure, the second cover being attached to the first cover and comprising a second housing, a second turnplate pivotably mounted on the second housing, and a plurality of second veiling plates movably mounted oh the second housing and the second turnplate, the second veiling plates being situated between the first veiling plates of the first cover; and a cap mounted on the first and second covers.

2. The apparatus as described in claim 1, wherein the first housing defines two pairs of first sliding slots respective in crossing directions.

3. The apparatus as described in claim 2, wherein the first turnplate is pivoted about a suppositional intersection of the two pairs of first sliding slots.

4. The apparatus as described in claim 2, wherein each first veiling plate is movable along the first housing by a guiding portion movably received in the corresponding first sliding slot of the first housing.

5. The apparatus as described in claim 1, wherein a first actuating post extends from the center of the first turnplate for pivoting the first turnplate relative to the first housing.

6. The apparatus as described in claim 5, wherein a receiving aperture is defined through the second housing and into the second turnplate for receiving the first actuating post of the first turnplate.

7. The apparatus as described in claim 1, wherein the first turnplate defines four first arcuate slots.

8. The apparatus as described in claim 7, wherein each first veiling plate is movably attached to the first turnplate by a fastener movably received in the first arcuate slot of the first turnplate.

9. The apparatus as described in claim 1, wherein a crossing gap is defined among the first veiling plates, and wherein the second veiling plates are arranged in a crossing shape for matingly received in the crossing gap.

10. The apparatus as described in claim 1, wherein when the first turnplate is rotated, the first veiling plates are exerted to move along the first housing.

11. The apparatus as described in claim 1, wherein the second housing defines two pairs of second sliding slots respective in crossing directions.

12. The apparatus as described in claim 11, wherein the second turnplate is pivoted about a suppositional intersection of the two pairs of second sliding slots.

13. The apparatus as described in claim 11, wherein each second veiling plate is movable along the second housing by a guiding portion movably received in a corresponding second sliding slot of the second housing.

14. The apparatus as described in claim 1, wherein a second actuating post extends from a center of the second turnplate for pivoting the second turnplate relative to the second housing.

15. The apparatus as described in claim 14, wherein the cap defines a hole for extension of the second actuating post of the second cover.

16. The apparatus as described in claim 1, wherein the second turnplate defines four second arcuate slots.

17. The apparatus as described in claim 16, wherein each second veiling plate is movably attached to the second turnplate by a fastener movably received in the second arcuate slot of the second turnplate.

18. The apparatus as described in claim 1, wherein when the second turnplate is rotated, the second veiling plates are exerted to move along the second housing.

19. An apparatus for veiling a predetermined position of a computer enclosure from coating, comprising:

a first cover accommodated in the predetermined position of the computer enclosure, said first cover comprising a first housing with a plurality of first veiling plates radially moveably mounted thereon; and a second cover accommodated in the predetermined position of the computer enclosure, said second cover mounting atop the first cover, said second cover comprising a second housing with a plurality of second veiling plates radially moveably mounted thereon; wherein said second veiling plates are alternatively snugly positioned between every adjacent two first veiling plates, respectively.

* * * * *